US011171413B2

(12) United States Patent
Hu et al.

(10) Patent No.: US 11,171,413 B2
(45) Date of Patent: Nov. 9, 2021

(54) MOVABLE DEVICE

(71) Applicant: SZ DJI TECHNOLOGY CO., LTD., Shenzhen (CN)

(72) Inventors: Meng Hu, Shenzhen (CN); Rongming Xiong, Shenzhen (CN); Risong Chen, Shenzhen (CN); Xianwu Xiong, Shenzhen (CN)

(73) Assignee: SZ DJI TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/365,971

(22) Filed: Mar. 27, 2019

(65) Prior Publication Data

US 2019/0221924 A1 Jul. 18, 2019

Related U.S. Application Data

(63) Continuation of application No. PCT/CN2016/100438, filed on Sep. 27, 2016.

(51) Int. Cl.

*H01Q 1/28* (2006.01)
*H01Q 3/06* (2006.01)
*H01Q 1/48* (2006.01)

(52) U.S. Cl.

CPC ..... *H01Q 1/28* (2013.01); *H01Q 1/286* (2013.01); *H01Q 3/06* (2013.01); *H01Q 1/48* (2013.01)

(58) Field of Classification Search

CPC ..... H01Q 1/28; H01Q 1/286; H01Q 3/06; H01Q 1/48; H01Q 1/12; H01Q 1/285; H01Q 1/27

See application file for complete search history.

(56) References Cited

U.S. PATENT DOCUMENTS 6,266,582 B1 * 7/2001 Bruckner ..... G01C 21/165 342/357.31
2004/0108963 A1 * 6/2004 Clymer ..... H01Q 15/242 343/837
2009/0189813 A1 7/2009 Haas et al.
2012/0130602 A1 5/2012 Omelchenko et al.
2012/0267472 A1 * 10/2012 Pratzovnick ..... B64C 39/024 244/13

(Continued)

FOREIGN PATENT DOCUMENTS

CN 1211833 A 3/1999
CN 1682402 A 10/2005

(Continued)

OTHER PUBLICATIONS

World Intellectual Property Organization (WIPO) International Search Report and Written Opinion for PCT/CN2016/100438 dated Jan. 20, 2017 5 Pages.

(Continued)

*Primary Examiner* — Andrea Lindgren Baltzell
*Assistant Examiner* — Michael M Bouizza
(74) *Attorney, Agent, or Firm* — Anova Law Group, PLLC

(57) ABSTRACT

A movable device includes a fuselage and a navigation antenna arranged at an edge portion of the fuselage. The navigation antenna is tilted relative to the fuselage. One side of the navigation antenna proximal to a center portion of the fuselage is at a higher level than another side of the navigation antenna distal from the center portion of the fuselage.

18 Claims, 9 Drawing Sheets

(56) References Cited

U.S. PATENT DOCUMENTS

| | | | | |
|---|---|---|---|---|
| 2013/0082881 | A1* | 4/2013 | Zhu | H01Q 9/40 343/700 MS |
| 2014/0306851 | A1 | 10/2014 | Hall et al. | |
| 2016/0059827 | A1 | 3/2016 | Uddin et al. | |
| 2017/0325221 | A1* | 11/2017 | Jalali | H01Q 21/205 |
| 2018/0086458 | A1* | 3/2018 | Sartorius | B64C 39/024 |
| 2018/0370624 | A1* | 12/2018 | Seale | B64C 27/16 |

FOREIGN PATENT DOCUMENTS

| | | | |
|---|---|---|---|
| CN | 1979946 | A | 6/2007 |
| CN | 201163658 | Y | 12/2008 |
| CN | 201616506 | U | 10/2010 |
| CN | 204315727 | U | 5/2015 |
| CN | 105281016 | A | 1/2016 |
| CN | 105356039 | A | 2/2016 |
| CN | 205029006 | U | 2/2016 |
| CN | 105652289 | A | 6/2016 |
| CN | 105818961 | A | 8/2016 |
| CN | 105823478 | A | 8/2016 |
| CN | 105857182 | A | 8/2016 |
| CN | 205561808 | U | 9/2016 |
| CN | 212541105 | U | 2/2021 |
| JP | H07106821 | A | 4/1995 |

OTHER PUBLICATIONS

Qian Gao, et al., Review on Technology for Autonomous Landing Guidance of UAV, Modern Navigation, Aug. 2016, pp. 309-312, No. 4.

* cited by examiner

MOVABLE DEVICE

CROSS-REFERENCE TO RELATED APPLICATION

This application is a continuation of International Application No. PCT/CN2016/100438, filed on Sep. 27, 2016, the entire contents of which are incorporated herein by reference.

TECHNICAL FIELD

The present disclosure relates to the field of aerial vehicle technology and, more particularly, to a movable device.

BACKGROUND

A navigation antenna is a component of a movable device and is usually installed horizontally at a top of a geometric center of the movable device to receive wireless signals transmitted from a satellite and convert the wireless signals through a receiver.

Usually, due to a need of industrial design, a metal profile of the movable device serves as a reflective surface for the navigation antenna. However, appearance of the movable device may have various shapes. The navigation antenna has a conformal shape as the movable device, to prevent generation of extra aerodynamic resistance to flight of the movable device. In these cases, it cannot be guaranteed that the navigation antenna is installed at the top of the geometric center of the movable device, and a metal profile of irregularly shaped movable device plays a role in guiding a direction pattern of the navigation antenna, and hence a direction pattern of the navigation antenna changes. To avoid changes to the direction pattern of the navigation antenna, in conventional approaches, the shape of the navigation antenna is changed, and various parameters of the navigation antenna are reevaluated to reduce changes to the direction pattern.

The above-mentioned process of suppressing the change of the direction pattern is achieved by changing the shape of the navigation antenna. However, changing the shape of the navigation antenna results in changes in antenna efficiency of the navigation antenna, and hence cannot ensure the efficiency of the antenna while improving the direction pattern of the antenna.

SUMMARY

In accordance with the disclosure, there is provided a movable device including a fuselage and a navigation antenna arranged at an edge portion of the fuselage. The navigation antenna is tilted relative to the fuselage. One side of the navigation antenna proximal to a center portion of the fuselage is at a higher level than another side of the navigation antenna distal from the center portion of the fuselage.

DETAILED DESCRIPTION OF THE EMBODIMENTS

Figure 1A:
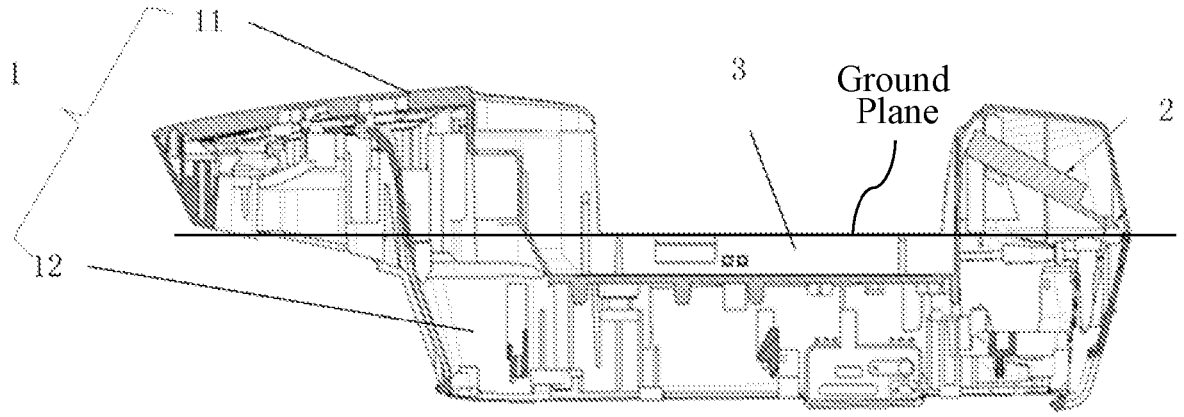
FIG. 1A is a schematic view of an example movable device consistent with embodiments of the present disclosure.

Technical solutions of the present disclosure will be described with reference to the drawings. It will be appreciated that the described embodiments are some rather than all of the embodiments of the present disclosure. Other embodiments conceived by those having ordinary skills in the art on the basis of the described embodiments without inventive efforts should fall within the scope of the present disclosure.

In the specification, claims, and accompanying drawings of the present disclosure, the terms "first," "second," "third," "fourth," and the like (if exist) are intended to distinguish between similar objects but do not necessarily indicate an order or sequence. It should be understood that the data termed in such a way are interchangeable in proper circumstances so that the embodiments of the present disclosure described herein can be implemented, for example, in orders other than the order illustrated or described herein. Moreover, the terms "include," "contain" and any other similar expressions mean to cover the non-exclusive inclusion, for example, a process, method, system, product, or device that includes a list of steps or units, and are not necessarily limited to those steps or units that are explicitly listed, but may include other steps or units not explicitly listed or inherent to such a process, method, system, product, or device.

As used herein, when a first component is referred to as "fixed to" a second component, it is intended that the first component may be directly attached to the second component or may be indirectly attached to the second component via another component. When a first component is referred to as "connecting" to a second component, it is intended that the first component may be directly connected to the second component or may be indirectly connected to the second component via a third component between them. The terms "perpendicular," "horizontal," "left," "right," and similar expressions used herein are merely intended for description.

Unless otherwise defined, all the technical and scientific terms used herein have the same or similar meanings as generally understood by one of ordinary skill in the art. As described herein, the terms used in the specification of the present disclosure are intended to describe example embodiments, instead of limiting the present disclosure. The term "and/or" used herein includes any suitable combination of one or more related items listed.

Further, in the present disclosure, the disclosed embodiments and the features of the disclosed embodiments may be combined when there are no conflicts.

Generally, for an unmanned aerial vehicle (UAV), a navigation antenna may be used as a built-in antenna and arranged in a middle of interior of a housing of the movable device, such as at a center of a horizontal plane. For example, the housing of the movable device may include a regular cuboid, and the navigation antenna may be horizontally arranged at a top of geometric center of the movable device, parallel to a plane formed by a pitch axis and a roll axis.

Appearance of the movable device may have various shapes. Due to influence of the shape of the movable device, it cannot be guaranteed that the navigation antenna is arranged at a top of the geometric center of the movable device. Influence of reflective surface of metal profile of an irregularly shaped movable device may be reduced, and an influence of direction guiding on a direction pattern of the navigation antenna may be increased, deviating the direction pattern of the navigation antenna. In order to suppress deviation of the navigation antenna's direction pattern, in conventional approaches, the shape of the navigation antenna may be changed, and various parameters of the navigation antenna may be reevaluated to reduce changes to the direction pattern.

Antenna efficiency of the navigation antenna is related to a projection area of the navigation antenna. The larger the projection area, the higher the antenna efficiency. Thus, if the shape of the navigation antenna is changed, the projection area of the navigation antenna hence may also be changed. Accordingly, the antenna efficiency of the navigation antenna may be changed. Thus, the direction pattern cannot be improved while the antenna efficiency is maintained.

Thus, the present disclosure provides a movable device. In the movable device, the navigation antenna may be tilted and arranged at an edge portion of the movable device, to realize improvement of the direction pattern while ensuring the antenna efficiency.

In some embodiments, the movable device may include an unmanned aerial vehicle (UAV), an unmanned vehicle, an unmanned boat, and/or the like. Detailed descriptions of some embodiments are made by taking a UAV, e.g., a multi-rotor UAV, as an example of the movable device.

FIG. 1A is a schematic view of an example movable device consistent with embodiments of the present disclosure. As shown in FIG. 1A, the movable device includes a fuselage 1 and a navigation antenna 2. The navigation antenna 2 is arranged at an edge portion of the fuselage 1. The navigation antenna 2 is tilted relative to the fuselage 1, such that one side of the navigation antenna 2 proximal to a center portion of the fuselage 1 is at a higher level than another side of the navigation antenna 2 distal from the center portion of the fuselage 1.

Figure 2A:
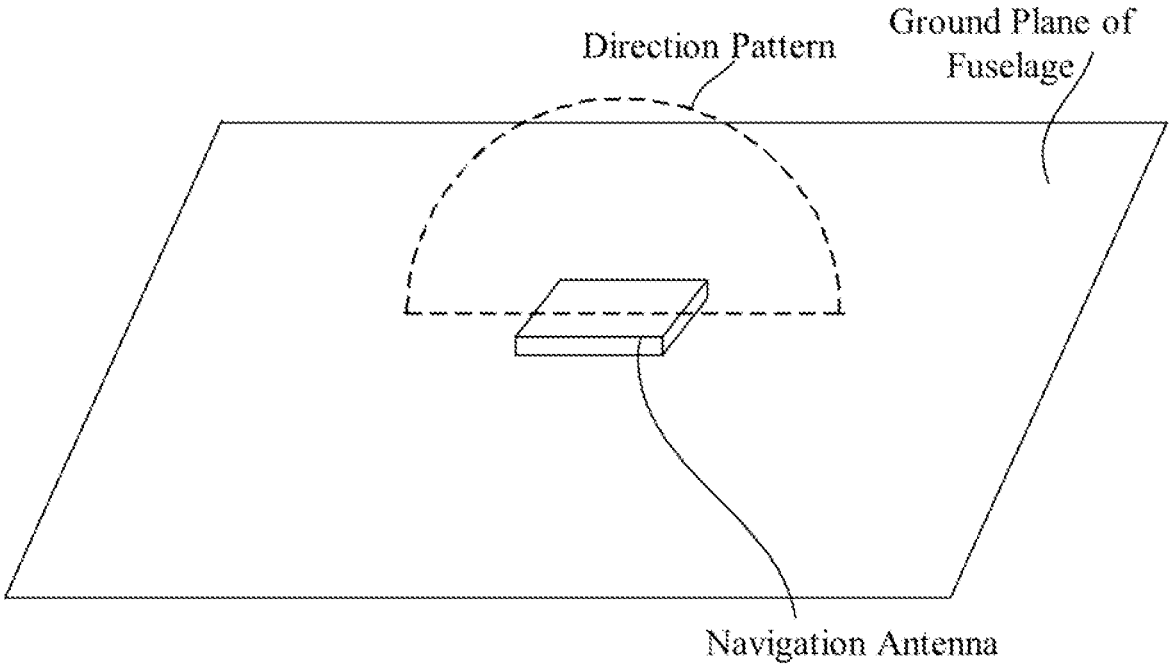
FIG. 2A is a schematic view of a direction pattern of a navigation antenna of a regularly shaped movable device when the navigation antenna is arranged horizontally.
Figure 2B:
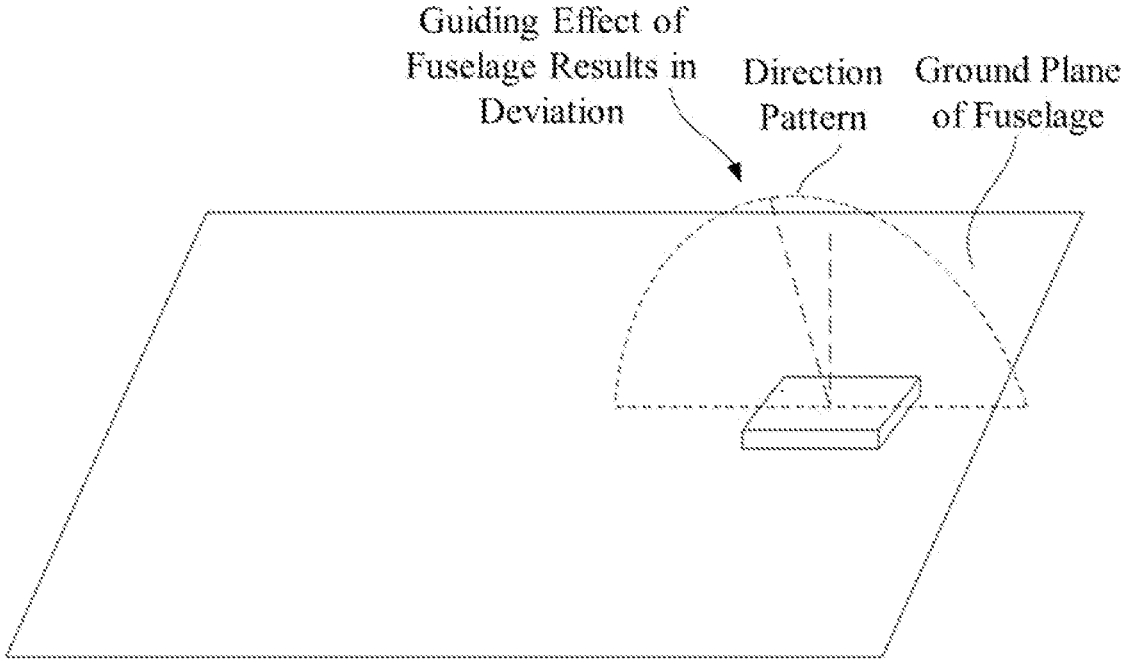
FIG. 2B is a schematic view of a direction pattern of a navigation antenna of an irregularly shaped movable device when the navigation antenna is arranged horizontally.
Figure 2C:
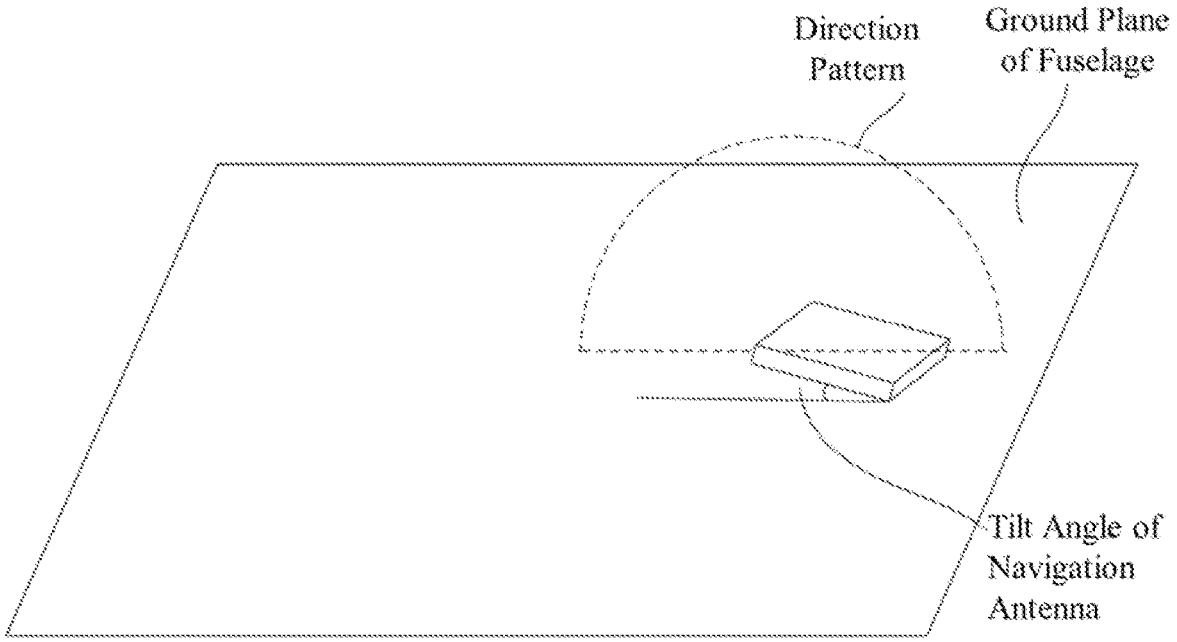
FIG. 2C is a schematic view of a direction pattern of a navigation antenna of an irregularly shaped movable device when the navigation antenna is tilted.

In some embodiments, the navigation antenna 2 for receiving a wireless signal may include a conformal shape with respect to the fuselage 1. The navigation antenna 2 may be arranged at an inner edge of the fuselage 1, and may be tilted relative to the fuselage 1. The tilt direction may be opposite to a deviation angle of direction pattern of the navigation antenna 2. In some embodiments, one side of the navigation antenna 2 proximal to a center portion of the fuselage 1 may be at a higher level than another side of the navigation antenna 2 distal from the center portion of the fuselage 1. Since the fuselage 1 exhibits a capacitive guiding effect, the direction pattern of the navigation antenna 2 may be deviated toward the center portion of the fuselage 1. A tilt direction of the navigation antenna 2 may be away from the center portion of the fuselage 2, such that a tilt angle of the navigation antenna 2 may be opposite to the deviation angle of the direction pattern of the antenna, to compensate for the guiding effect of the fuselage 1. Referring to FIGS. 2A, 2B, and 2C, FIG. 2A is a schematic view of a direction pattern of a navigation antenna of a regularly shaped movable device when the navigation antenna is arranged horizontally, FIG. 2B is a schematic view of a direction pattern of a navigation antenna of an irregularly shaped movable device when the navigation antenna is arranged horizontally, and FIG. 2C is a schematic view of a direction pattern of a navigation antenna of an irregularly shaped movable device when the navigation antenna is tilted.

Referring to FIG. 2A, the movable device includes a regularly shaped movable device, the navigation antenna is arranged at a top of the geometric center of the movable device, parallel to a plane formed by a pitch axis and a roll axis, i.e, a ground plane of the fuselage shown in the figure. In this example, the direction pattern is not deviated.

Referring to FIG. 2B, the movable device includes an irregularly shaped mobile device, and the navigation antenna is arranged at an end portion of the movable device, such as a head portion and/or a tail portion. In this example, due to the guiding effect of the irregularly shaped fuselage 1, the direction pattern is deviated. As shown in FIG. 2B, the direction pattern is deviated to the left. That is, a radius of the portion of the direction pattern on the left of a vertical dashed line is larger than a radius of the portion of the direction pattern on the right of the vertical dashed line.

Referring to FIG. 2C, in order to compensate for the guiding effect of the fuselage 1, in some embodiments, the navigation antenna is tilted, and the tilt angle is opposite to the deviation direction of the direction pattern in FIG. 2B, i.e., the navigation antenna is tilted to the right. In some embodiments, a left side of the navigation antenna 2 that is proximal to the center portion of the fuselage 1 may be raised, such that the left side of the navigation antenna 2 that is proximal to the center portion of the fuselage 1 is at a higher level than a right side of the navigation antenna 2 that is distal from the center portion of the fuselage 1. As the navigation antenna 2 is tilted, the direction pattern of the navigation antenna 2 is no longer deviated, and has the status shown in FIG. 2A.

In the embodiments of the present disclosure, the movable device includes the fuselage 1 and the navigation antenna 2 arranged tiltedly at an edge portion of the fuselage 1. One side of the navigation antenna 2 proximal to a center portion of the fuselage 1 may be at a higher level than another side of the navigation antenna 2 distal from the center portion of the fuselage 1. Since the fuselage 1 exhibits a capacitive guiding effect, the direction pattern of the navigation antenna 2 may be deviated toward the center portion of the fuselage 1. A tilt direction of the navigation antenna 2 may be configured to be away from the center portion of the fuselage 2, such that a tilt angle of the navigation antenna 2 may be opposite to the deviation angle of the direction pattern of the antenna, thus compensating for the guiding effect of the irregularly shaped fuselage 1 on the navigation antenna 2. The direction pattern can be improved while ensuring the antenna efficiency.

In some embodiments, the navigation antenna 2 may be arranged at an end portion of the fuselage 1. For example, the navigation antenna 2 may be arranged at a head portion of the movable device. As another example, the navigation antenna 2 may be arranged at a tail portion of the movable device. As another example, one navigation antenna 2 may be arranged at each of the head portion and the tail portion of the movable device.

Figure 3A:
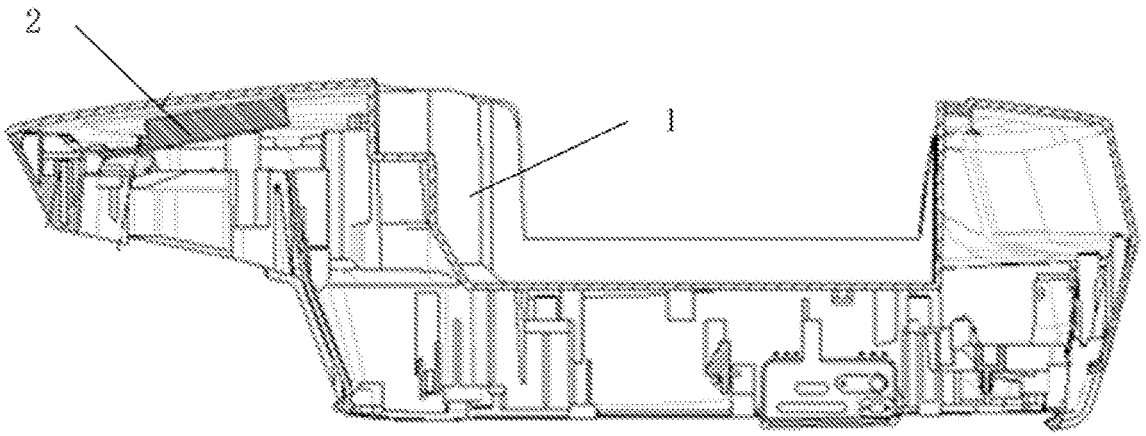
FIG. 3A is a schematic view of another example movable device consistent with embodiments of the present disclosure.
Figure 4:
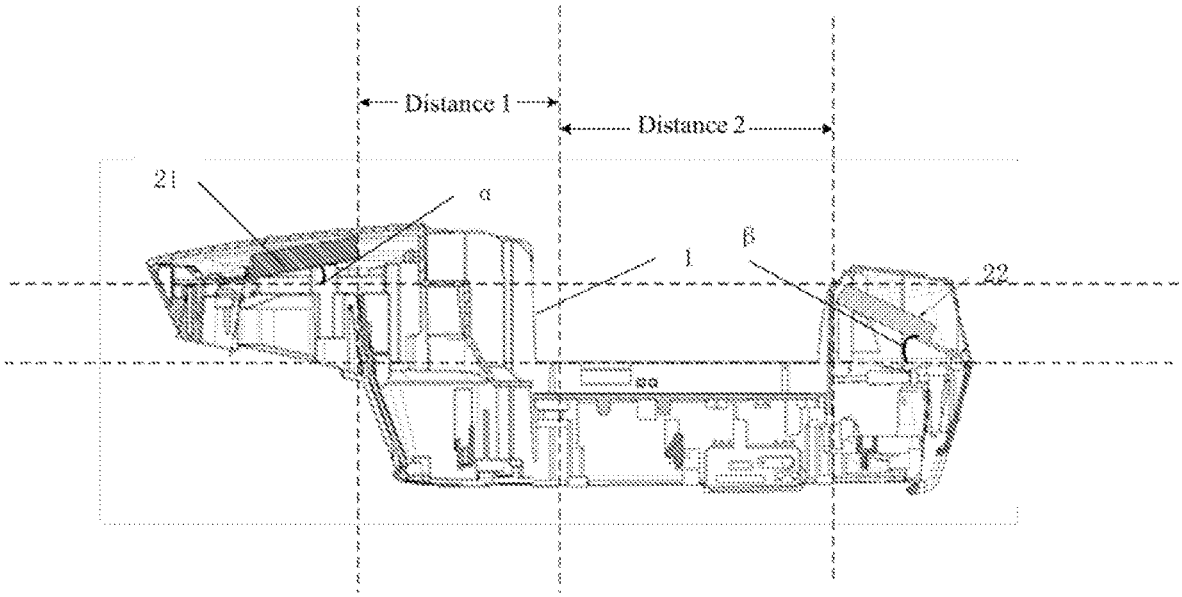
FIG. 4 is a schematic view of another example movable device consistent with embodiments of the present disclosure.

In some embodiments, the movable device may have a radiative component such as a battery in a middle portion of the movable device. If the middle portion of the movable device is considered as a geometric center of the movable device, the battery or other component may occupy the position originally used for arranging the navigation antenna 2. In some embodiments, the navigation antenna 2 may be flexibly arranged at a head portion, a tail portion, or both head portion and tail portion of the fuselage 1, such that the navigation antenna 2 can co-exist with the radiative components such as the battery, without interfering with the radiative components. Referring to FIGS. 1A, 3A, and 4, FIG. 3A is a schematic view of another example movable device consistent with embodiments of the present disclosure, and FIG. 4 is a schematic view of another example movable device consistent with embodiments of the present disclosure. In FIG. 1A, the navigation antenna 2 is arranged at the tail portion of the movable device. In FIG. 3A, the navigation antenna 2 is arranged at the head portion of the movable device. In FIG. 4, multiple navigation antennas 2 are arranged at both head portion and tail portion of the movable device.

Referring to FIG. 4, the navigation antennas 2 are arranged at both head portion and tail portion of the movable device. The navigation antennas 2 includes a first navigation antenna 21 and a second navigation antenna 22. The first navigation antenna 21 is arranged at the head portion of the movable device. The second navigation antenna 22 is arranged at the tail portion of the movable device.

Further, when the movable device moves forward, the first navigation antenna 21 is in operation. When the movable device moves backward, the second navigation antenna 22 is in operation.

However, the present disclosure is not limited thereto. In some embodiments, the first navigation antenna 21 and the second navigation antenna 22 may operate at a same time. For example, the first navigation antenna 21 and the second navigation antenna may both be a real time kinematic (RTK) antenna, and correspondingly the first navigation antenna 21 and the second navigation antenna 22 may operate at a same time. In some embodiments, the first navigation antenna 21 and the second navigation antenna 22 may be switched to each other. For example, when the movable device moves forward, the first navigation antenna 21 may be in operation. If the signal of the first navigation antenna 21 is weak, the movable device can switch to the second navigation antenna 22 for receiving wireless signals through the second navigation antenna 22.

In some embodiments, a preset angle of the tilt of the navigation antenna 2 with respect to the fuselage 1 may increase as a distance between the navigation antenna 2 and the central portion of the fuselage 1 increases. For example, referring to FIG. 4, the dashed line in the middle indicates a center line of the movable device, a distance between the first navigation antenna 21 and the center portion of the fuselage 1 is distance 1, and the first navigation antenna 21 has a preset tilt angle $\alpha$ with respect to a plane formed by a pitch axis and a roll axis, indicated by the horizontal dashed line in FIG. 4. A distance between the second navigation antenna 22 and the center portion of the fuselage 1 is distance 2, and the second navigation antenna 22 has a preset tilt angle $\beta$ with respect to the plane formed by the pitch axis and the roll axis. Because distance 1 is smaller than distance 2, the preset tilt angle of the first navigation antenna 21 with respect to the fuselage 1 is smaller than the preset tilt angle of the second navigation antenna 22 with respect to the fuselage 1. That is, $\alpha<\beta$.

In some embodiments, the navigation antenna 2 may be arranged at a side position of the fuselage 1, such that the arranged position of the navigation antenna 2 is not limited to the head portion or the tail portion of the movable device, and the navigation antenna 2 can be arranged flexibly.

Figure 5:
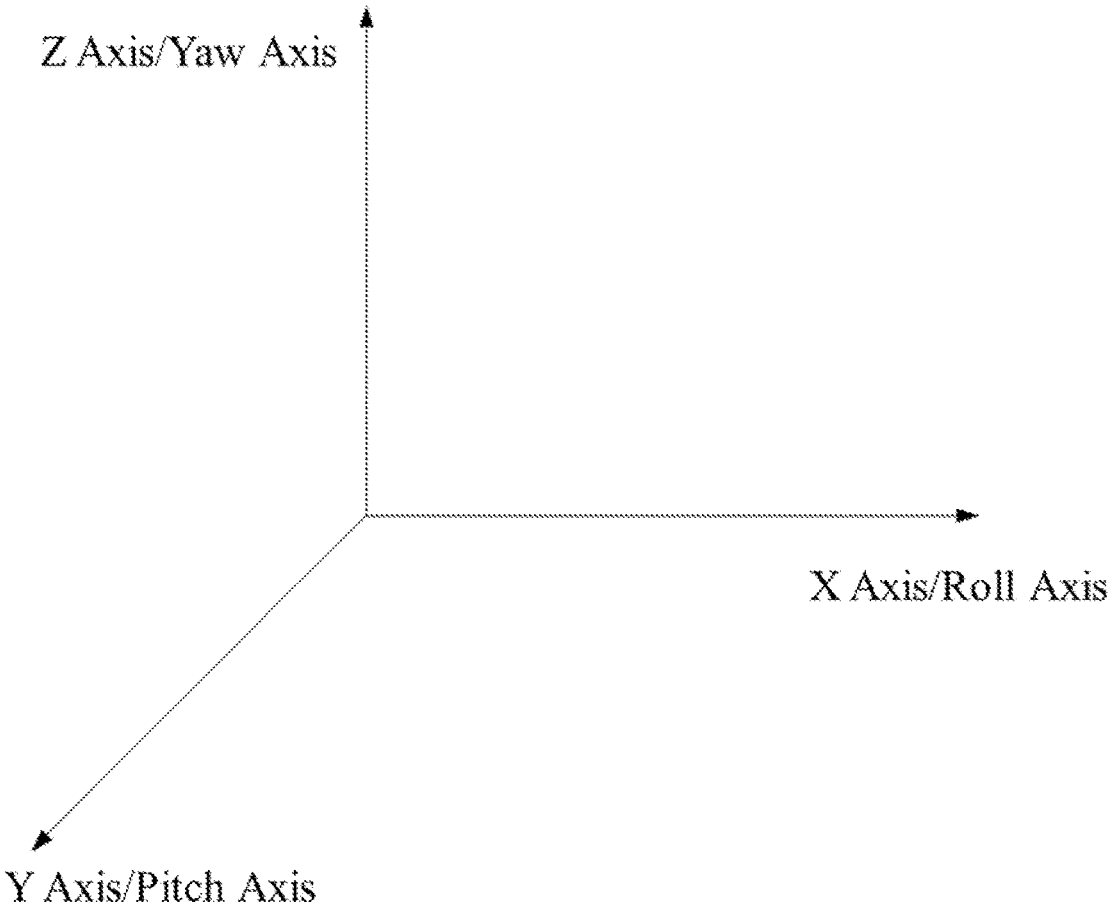
FIG. 5 is a three-dimensional coordinate diagram suitable for an example movable device consistent with embodiments of the present disclosure.

FIG. 5 shows a three-dimensional coordinate system suitable for an example movable device consistent with embodiments of the present disclosure. As shown in FIG. 5, X axis, Y axis, and Z axis are a pitch axis, a roll axis, and a yaw axis, respectively.

Referring to FIG. 5, in some embodiments, the navigation antenna 2 is tilted relative to the fuselage 1. In some embodiments, the navigation antenna 2 is tilted at a preset angle with respect to a plane formed by the roll axis and the pitch axis of the movable device. The preset angle may be between 1 degree and 60 degrees. For example, the navigation antenna 2 may be tilted at 5 degrees, 10 degrees, 12 degrees, 15 degrees, 18 degrees, and 25 degrees. 28 degrees, 30 degrees, 35 degrees, 38 degrees, 42 degrees, 46 degrees, 49 degrees, 50 degrees, 53 degrees, 55 degrees, 58 degrees, or 60 degrees. In some embodiments, the preset angle between the navigation antenna 2 and the plane formed by the roll axis and the pitch axis of the movable device may be between 30 degrees and 50 degrees, such as, 30 degrees, 33 degrees, 35 degrees, 37 degrees, 38.5 degrees, 40 degrees, 45 degrees, or 50 degrees.

Referring to FIG. 5, in some embodiments, the navigation antenna 2 is tilted with respect to the fuselage 1. In some embodiments, the navigation antenna 2 may be tilted at a preset angle with respect to a yaw axis of the movable platform. The preset angle may be between 30 degree and 89 degrees, such as 30 degrees, 32 degrees, 35 degrees, 38 degrees, 40 degrees, 42 degrees, 46 degrees, 48.6 degrees, 50 degrees, 52 degrees, 57 degrees, 60 degrees, 64 degrees, 67 degrees, 69 degrees, 70 degrees, 72 degrees, 74.7 degrees, 76 degrees, 79 degrees, 80 degrees, 83 degrees, 85.2 degrees, 86 degrees, 88 degrees, or 89 degrees. In some embodiments, the preset angle between the navigation antenna 2 and the yaw axis of the movable device may be between 40 degrees and 60 degrees, such as 40 degrees, 45 degrees, 50 degrees, 53 degrees, 55 degrees, 58 degrees, or 60 degrees.

Referring to FIG. 5, in some embodiments, the navigation antenna 2 is tilted relative to the fuselage 1. In some embodiments, the navigation antenna 2 is parallel to the yaw axis of the movable device. That is, the navigation antenna 2 is arranged approximately parallel to the yaw axis of the movable device or completely parallel to the yaw axis of the movable device.

In some embodiments, from the perspective of antenna polarization, the navigation antenna 2 may include a right-handed antenna or the like. From the perspective of frequency band, the navigation antenna 2 may include a global positioning system (GPS) antenna or a Russian's global navigation satellite system (GLONASS) antenna, a Wi-Fi antenna, etc. When the navigation antenna 2 includes a GPS antenna, the navigation antenna 2 may have, for example, a right hand circular polarization (RHCP), such that the navigation antenna 2 can smoothly receive wireless signals.

In some embodiments, the fuselage 1 may include a housing and an electricity compartment. The electricity compartment may be arranged in the middle of a top of the housing. The navigation antenna 2 may be arranged in the housing.

Referring to FIG. 1A, the housing of the fuselage 1 includes an upper cover 11 and a lower cover 12 that can be coupled to each other. Coupled upper cover and the lower cover form an accommodating space, and an electricity compartment 3 is arranged in the middle of the top of the accommodating space. The navigation antenna 2 is arranged at an edge portion in the accommodating space, such as a head portion and/or a tail portion in the accommodation space. In some embodiments, as shown in FIG. 1A, the electricity compartment 3 may include a battery compartment for accommodating a battery.

In some embodiments, as shown in, e.g., FIG. 1B, a circuit board 4 is arranged below the navigation antenna 2. The circuit board 4 may be arranged parallel to the plane formed by the roll axis and the pitch axis of the movable device.

Figure 3B:
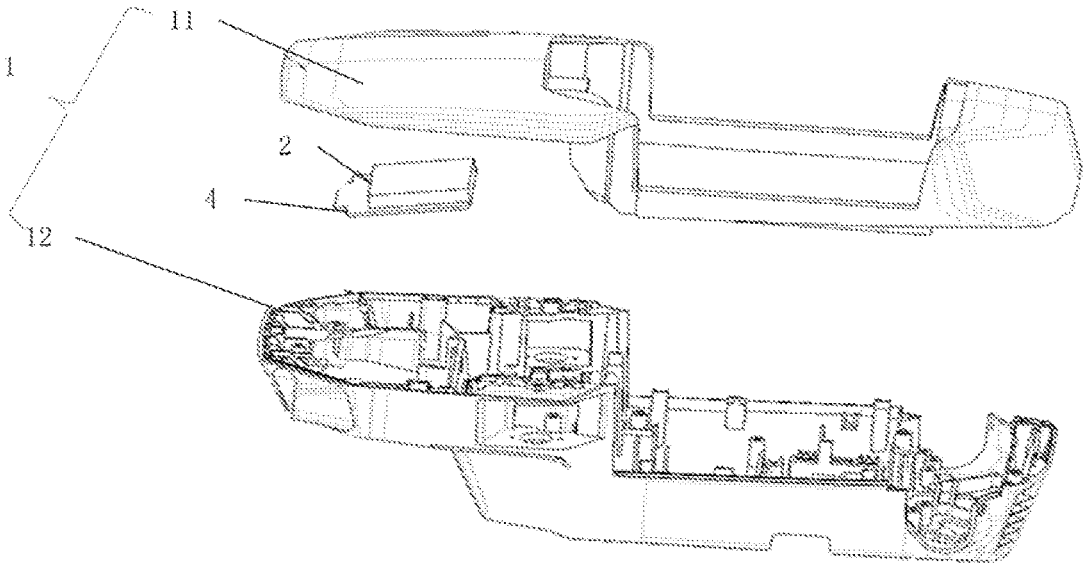
FIG. 3B is an exploded view of the movable device shown in FIG. 3A.

In the embodiments described above in connection with FIGS. 1A, 3A, and 4, the navigation antenna 2 includes a passive antenna, and the passive antenna can be integrated with a receiver 4 of the movable device. In FIGS. 1A, 3A, and 4, the housing of the fuselage 1 includes the upper cover 11 and the lower cover 12 that are coupled to each other. For clarity, a schematic view in which the upper cover 11 and the lower cover 12 of the housing of the fuselage 1 are separated is illustrated, and FIGS. 1B and 3B can be referred to for detail. FIG. 1B is an exploded view of the movable device shown in FIG. 1A. FIG. 3B is an exploded view of the movable device shown in FIG. 3A.

Figure 1B:
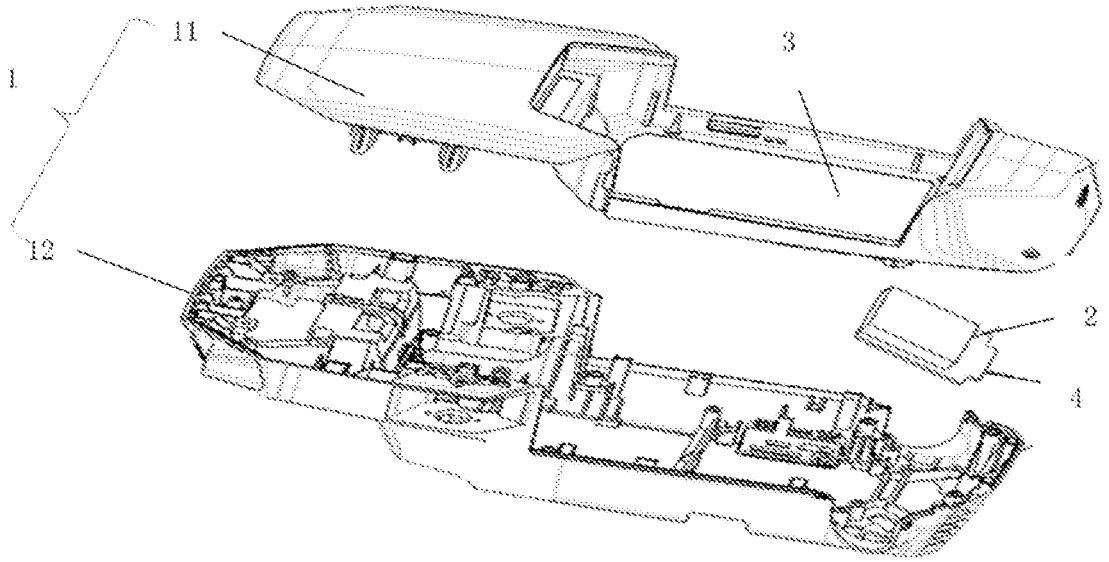
FIG. 1B is an exploded view of the movable device shown in FIG. 1A.

Referring to FIG. 1B and FIG. 3B, when the navigation antenna 2 is a passive antenna, the navigation antenna 2 is integrated with the circuit board 4. The circuit board 4 may include, for example, a global navigation satellite system (GNSS) receiver.

Figure 6A:
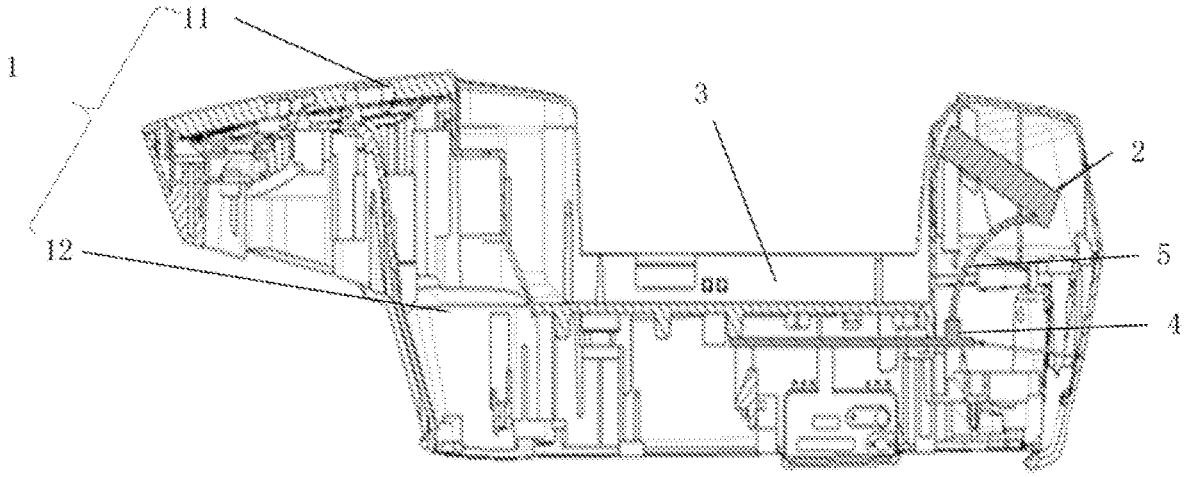
FIG. 6A is a schematic view of another example movable device consistent with embodiments of the present disclosure.
Figure 6B:
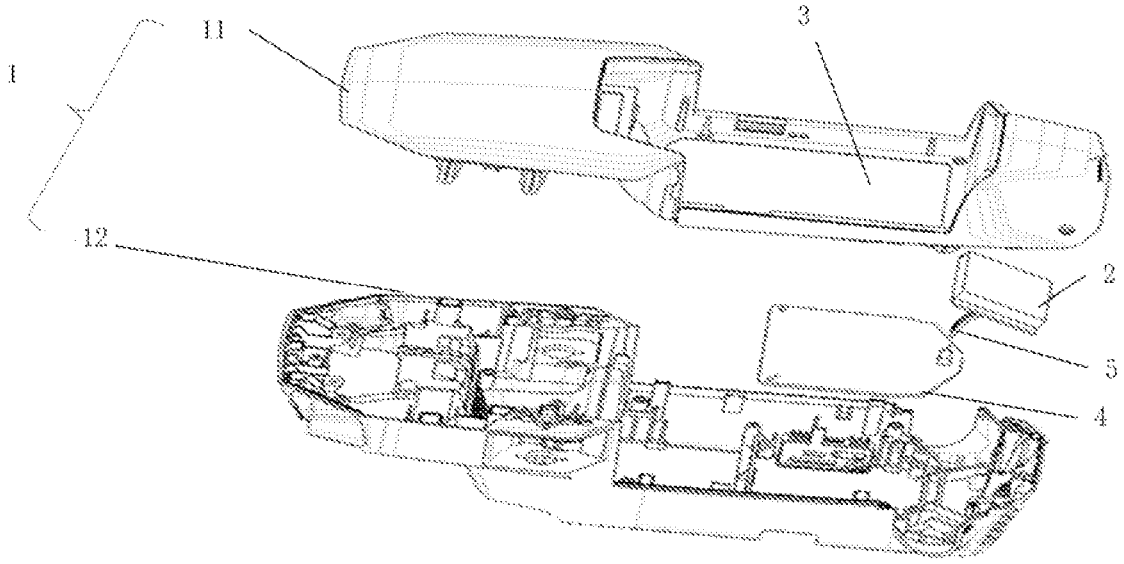
FIG. 6B is an exploded view of the movable device shown in FIG. 6A.

In some embodiments, the navigation antenna 2 may include an active antenna instead of a passive antenna. Referring to FIGS. 6A and 6B, FIG. 6A is a schematic view of another example movable device consistent with embodiments of the present disclosure. FIG. 6B is an exploded view of the movable device shown in FIG. 6A.

Referring to FIGS. 6A and 6B, when the navigation antenna 2 includes an active antenna, the navigation antenna 2 is separated from the circuit board 4, and coupled to the circuit board 4 through a radio frequency cable 5 or the like.

Figure 7A:
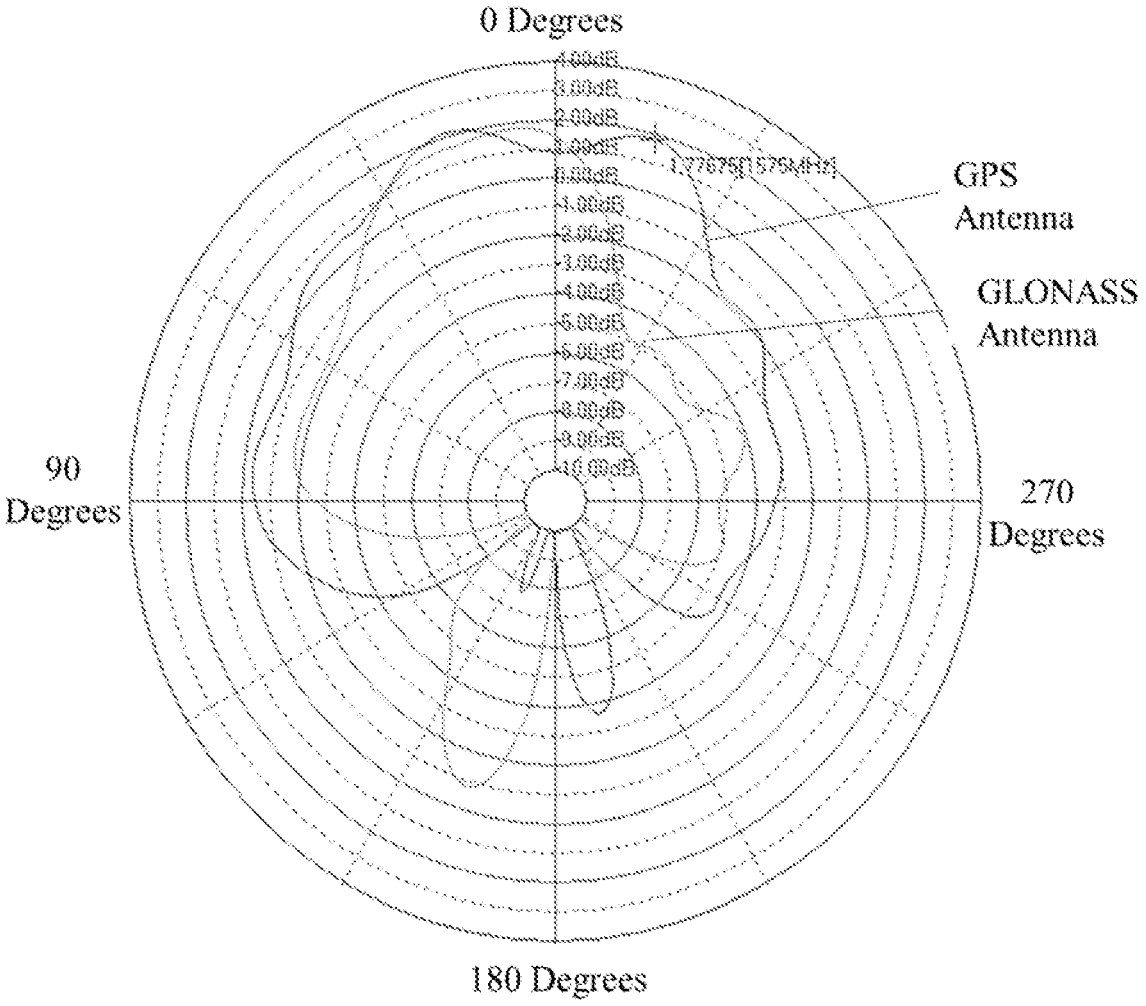
FIG. 7A is a lobe gain simulation diagram when a navigation antenna is not tilted.
Figure 7B:
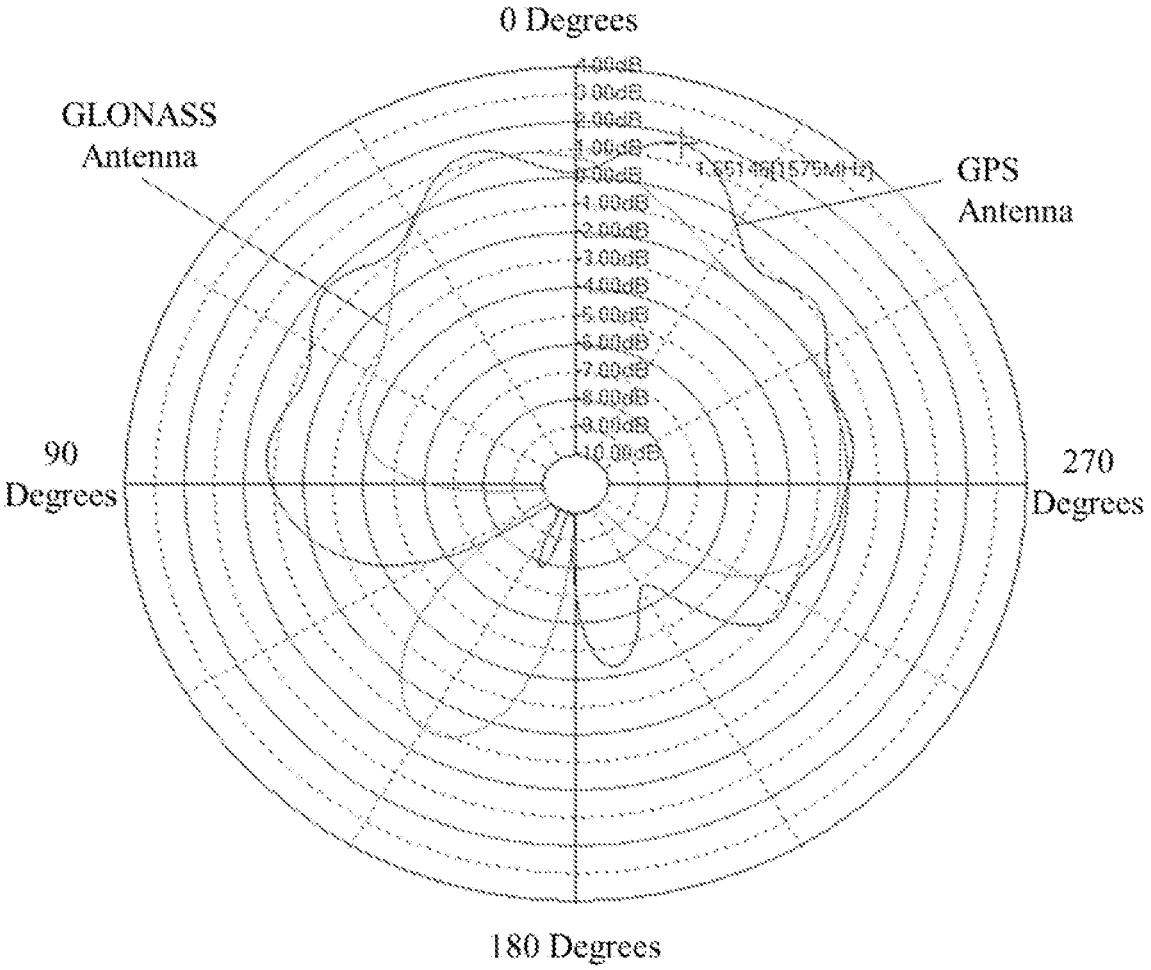
FIG. 7B is a lobe gain simulation diagram when a navigation antenna is tilted.

Antenna efficiency of a navigation antenna is usually measured by four key parameters such as gain, voltage standing wave ratio (VSWR), noise figure, axial ratio, and/or the like. From the perspective of gain, detailed descriptions are made for improving performance of the direction pattern while ensuring antenna efficiency of the movable device in the movable device consistent with the disclosure. Referring to FIGS. 7A and 7B, FIG. 7A is a lobe gain simulation diagram for a navigation antenna that is not tilted, and FIG. 7B is a lobe gain simulation diagram for a navigation antenna that is tilted.

Referring to FIG. 7A, as the navigation antenna is horizontally arranged, lobe gains of a GPS antenna and a GLONASS antenna are attenuated in a tail direction of the movable device. As shown in FIG. 7A, lobe gains between approximately 270 degrees and approximately 360 degrees, i.e., approximately 0 degrees, are attenuated, such that lobe gain curves between approximately 0 degrees and approximately 90 degrees are asymmetric with respect to lobe gain curves between approximately 270 degrees and approximately 360 degrees, i.e., approximately 0 degrees. In FIG. 7B, when the navigation antenna is tilted, lobe gains of a GPS antenna and a GLONASS antenna both are compensated in the tail direction of the movable device, such that lobe gain curves between approximately 0 degrees and approximately 90 degrees are approximately symmetrical with respect to lobe gain curves between approximately 270 degrees and approximately 360 degrees, i.e., approximately 0 degrees.

A method consistent with the disclosure can be implemented in the form of computer program stored in a non-transitory computer-readable storage medium. The computer program can include instructions that enable a computing device, such as a processor, a personal computer, a server, or a network device, to perform part or all of a method consistent with the disclosure, such as one of the example methods described above. The storage medium can be any medium that can store program codes, for example, a USB disk, a mobile hard disk, a read-only memory (ROM), a random access memory (RAM), a magnetic disk, or an optical disk.

Other embodiments of the disclosure will be apparent to those skilled in the art from consideration of the specification and practice of the embodiments disclosed herein. It is intended that the specification and examples be considered as example only and not to limit the scope of the disclosure, with a true scope and spirit of the invention being indicated by the following claims.

What is claimed is:

1. A movable device comprising:

a fuselage including an upper portion and a lower portion;

a navigation antenna arranged at an edge portion of the upper portion of the fuselage;

a battery compartment arranged at both a center portion and the upper portion of the fuselage and configured to accommodate a battery; and a circuit board arranged in the lower portion of the fuselage below both the navigation antenna and the battery compartment, the circuit board being parallel to a bottom of the battery compartment, wherein:

the navigation antenna is tilted relative to the fuselage, and one side of the navigation antenna proximal to the center portion of the fuselage is at a higher level than another side of the navigation antenna distal from the center portion of the fuselage.

2. The movable device according to claim 1, wherein the navigation antenna is arranged at an end portion of the fuselage.

3. The movable device according to claim 1, wherein:

the navigation antenna is a first navigation antenna arranged at a head portion of the movable device;

the movable device further comprising:

a second navigation antenna arranged at a tail portion of the movable device.

4. The movable device according to claim 3, wherein:

the first navigation antenna is configured to operate when the movable device moves forward; and the second navigation antenna is configured to operate when the movable device moves backward.

5. The movable device according to claim 1, wherein the navigation antenna is arranged at a side of the fuselage.

6. The portable device according to claim 1, wherein:
the navigation antenna is tilted at a preset angle with respect to the fuselage; and
the preset angle is positively correlated with a distance between the navigation antenna and the center portion of the fuselage.

7. The movable device according to claim 1, wherein:
the navigation antenna is titled at a preset angle with respect to a plane formed by a roll axis and a pitch axis of the movable device.

8. The movable device according to claim 7, wherein:
the preset angle is between approximately 1 degree and approximately 60 degrees.

9. The movable device according to claim 8, wherein:
the preset angle is between approximately 10 degrees and approximately 45 degrees.

10. The movable device according to claim 1, wherein:
the navigation antenna is tilted at a preset angle with respect to a yaw axis of the movable device.

11. The movable device according to claim 10, wherein:
the preset angle is between approximately 30 degrees and approximately 89 degrees.

12. The movable device according to claim 11, wherein:
the preset angle is between approximately 40 degrees and approximately 60 degrees.

13. The movable device according to claim 1, wherein:
the navigation antenna is parallel to a pitch axis of the movable device.

14. The movable device according to claim 1, wherein:
the navigation antenna includes one of a global position system (GPS) antenna or a Russian's global navigation satellite system (GLONASS) antenna.

15. The movable device according to claim 1, wherein:
the fuselage includes a housing;
and
the navigation antenna is arranged in the housing.

16. The movable device according to claim 1, wherein:
the circuit board is parallel to a plane formed by a roll axis and a pitch axis of the movable device.

17. The movable device according to claim 1, wherein the navigation antenna includes a passive antenna integrated with the circuit board.

18. The movable device according to claim 1, wherein:
the navigation antenna includes an active antenna separated from the circuit board; and
the active antenna is coupled to the circuit board through a radio frequency cable.

* * * * *